United States Patent [19]

Gater et al.

[11] 4,444,697

[45] Apr. 24, 1984

[54] METHOD AND APPARATUS FOR COOLING A CRACKED GAS STREAM

[75] Inventors: Roger A. Gater, Dover; Herbert D. Michelson, Fort Lee, both of N.J.

[73] Assignee: Exxon Research & Engineering Co., Florham Park, N.J.

[21] Appl. No.: 264,223

[22] Filed: May 18, 1981

[51] Int. Cl.[3] ..... B01F 3/04

[52] U.S. Cl. ..... 261/118; 208/48 Q; 261/112; 261/116; 422/207

[58] Field of Search ..... 261/79 A, 112, 116, 261/118, DIG. 9, DIG. 54; 422/207; 208/48 Q

[56] References Cited

U.S. PATENT DOCUMENTS

| | | | |
|---|---|---|---|
| 2,442,898 | 6/1948 | Maguire | 208/48 Q X |
| 3,224,215 | 12/1965 | Bramekamp et al. | 261/118 X |
| 3,284,168 | 11/1966 | Braconier et al. | 422/207 |
| 3,515,519 | 6/1970 | Sennewald et al. | 422/207 X |
| 3,524,630 | 8/1970 | Marion | 261/118 X |
| 3,593,968 | 7/1971 | Geddes et al. | 261/118 |
| 3,758,081 | 9/1973 | Prudhon | 261/118 X |
| 3,907,661 | 9/1975 | Gwyn et al. | 208/48 Q |
| 4,058,378 | 11/1977 | Saxton | 261/118 X |
| 4,121,908 | 10/1978 | Raab et al. | 422/207 |

OTHER PUBLICATIONS

Publication of D. L. Emmons, Jr., Titled "Effects of Selected Gas Stream Parameters and Coolant Physical Properties on Film Cooling of Rocket Motors".

*Primary Examiner*—Richard L. Chiesa
*Attorney, Agent, or Firm*—Rebecca Yablonsky

[57] ABSTRACT

The invention relates to quenching a cracked hydrocarbon gas by passing a cracked gas stream axially through a pipe and injecting a liquid coolant into said pipe through a plurality of circumferentially arranged slots in a swirling manner, the weight ratio of the flow rate of the coolant to the flow rate of the gas stream being in the range of about 2 to about 15 whereby a sufficient amount of the coolant is swept into the gas stream to effectively cool the same. Suitable apparatus comprises a quench pipe formed of two substantially abutting sections, the downstream section being grooved to form with the upstream section of said slots. Preferably the upstream section has an internal circumferentially arranged deflector lip overhanging the slots.

13 Claims, 2 Drawing Figures

METHOD AND APPARATUS FOR COOLING A CRACKED GAS STREAM

FIELD OF THE INVENTION

This invention relates to a method and apparatus for cooling a cracked gas stream from a hydrocarbon cracking furnace or apparatus and more particularly to cooling a cracked gas stream through a large temperature differential.

In the pyrolysis of petroleum fractions including but not limited to naphtha, gas oil or ethane, e.g., in steam cracking furnaces, for the production of products including low molecular weight unsaturated hydrocarbons, especially $C_2$ to $C_4$ olefins and diolefins, e.g., ehtylene, it is essential to cool the effluent gas rapidly to avoid further reactions which reduce selectively to the desired olefins. Cooling is carried out in a quench point or quench pipe receiving the effluent gas. The manner of carrying out this cooling/quenching, with particular regard to avoiding thermal stresses, mitigating coke formation upon the wall of the pipe and preserving the metal pipe, is the subject of this invention.

BACKGROUND OF THE INVENTION

When a cooling liquid is injected into a duct through which a hot cracked gas is passing, in a manner such that the liquid contacts the inner surface of the duct wall randomly or non-symmetrically, such introduction of the coolant does not achieve a uniform temperature with respect to a cross-section of the duct at that location. The temperature should be substantially uniform around a cut, in a single plane, of the duct wall; otherwise thermal stresses result which, if they are high enough, cause permanent deformation of the metal wall. Additionally, there are wet and dry areas which fluctuate so that, in dry areas which have previously been wetted and where some drops of liquid remain, polymerization can take place with formation of coke deposits. Such coke deposits increase the pressure drop across the quench pipe, resulting in a reduced selectivity to the desired olefins.

In U.S. Pat. No. 4,121,908, cooling oil is introduced into an annular space between vertical coaxial pipes at a location where the cracked gas has not yet emerged, since the cracked gas outlet is downstream of the quench oil inlets. Thus, the outer duct, at the location of an annular gap, receives the cooling oil which cools the wall of the inner pipe. Consequently, hot cracked products of high molecular weight, e.g., from gas oil feeds, can deposit on the inner surface of the inner pipe. The cracked effluent at that location has not yet come in contact with the quench oil which could act as a flux for the tarry products. Also, the oil is introduced between two pipes and thus is subject to frictional forces from both sides. This creates a drag and slows down the swirling or spiral motion of the oil. Additionally, the quench point described is meant to operate with gas/-quench oil flow downward whereas in the subject quench point flow can be in any direction.

U.S. Pat. No. 3,593,968 discloses an apparatus in which nozzles spray quench liquid into a downwardly flowing stream of cracked gas and separate means are used to direct a film of quench liquid downwardly on the wall of the chamber through which the gas is passing. This system is therefore limited in that only a vertical downflow arrangement can be employed.

SUMMARY OF THE INVENTION

In the present invention there are two coaxial pipes or walls defining a plenum chamber. Oil is introduced preferably tangentially to the plenum through inlets. The inner pipe, at a location close to the outlet of the cracking tubes, is provided with a plurality of circumferentially arranged slots which are slanted so that the cooling oil flows in tangentially or substantially tangentially. On the inner surface of this pipe an overhang or deflector lip may be provided which extends slightly over the slots to prevent backflow. The object of this invention is to have a definite separation between wet/dry wall areas since fluctuating patterns of wet/dry areas will promote coking and non-symmetric patterns will introduce mechanical problems in the duct wall due to temperature differences between adjacent portions. Conveniently the duct is formed from two pieces of pipe which substantially abut each other in the slot area and which, at the temperatures of use, expand and approach closely.

Thus it has now been found that cracked gaseous products can be quenched while avoiding the above described problems by injecting a cooling liquid into a duct through which the gas is passing, through slots circumferentially arranged, in a manner such that the cooling liquid is introduced into the duct in a swirling fashion. The number of slots and size of the slots should afford enough open cross-sectional area to provide a copious flow of liquid and thereby permit a sufficient amount of liquid coolant to be swept into the gas stream to effectively cool the same. Generally a moderate number of injection slots are used which are large in cross-sectional dimensions. The process involves a high weight ratio of injected liquid flow to gas stream flow. Swirl-type, tangential injection is used to ensure good distribution of a portion of the liquid around and along the inside surface of the duct and the wall liquid film is very long, of the order of 8 to 15 feet. Centrifugal force keeps the liquid on the wall and allows this quench configuration to be used in any orientation with respect to horizontal. A very substantial portion of the liquid is sheared off by the gas and enters the gas stream where it cools the gas by transfer of sensible heat and, if volatile, also by evaporation.

The ratio of coolant flow to gas flow depends on the initial temperatures of the two streams and the desired mix temperature. Typically the weight ratio of flow rate of coolant to flow rate of gas is in the range of about 2 to about 5, usually about 2.5 to about 4.0 when the coolant is one which vaporizes readily under the conditions used, for example a gas oil fraction. However, with decreasing volatility of the coolant the ratio may range above 5 and when a high boiling or bottoms oil fraction which vaporizes only slightly under the conditions is used as quench, this ratio can be as high as about 15:1. Thus the ratio will be selected from a range of about 2 to about 15 depending on whether the coolant is a naphtha, a light gas oil, a heavy gas oil or heavier fraction.

It has been found that by means of the present invention a substantial portion, preferably above 50% to about 90%, e.g., about 80%, of the coolant is physically entrained by the cracked gas stream away from the duct wall and into the cracked gas where good mixing, heat transfer and (in the case of a volatile liquid) evaporation of the injected liquid ensues with quenching of the gas stream. A preferably lesser portion of the liquid provides a wet film over the inner surface of the duct. Thus the present invention achieves both quenching, preferably with a preponderant amount of the liquid, of the gas and maintenance of a uniform wet wall area. The latter prevents coke formation upon the duct walls during the quenching process.

As contrasted with the measures used in U.S. Pat. No. 4,121,908 the cracked effluent is contacted with quench oil coming through the slots and any deposits that might tend to form would be fluxed by the oil. Consequently, it is effective for use both with heavy gas oil or with lighter naphtha cracking systems. Additionally, the oil is swirling only against the inner surface of the duct so that there is friction only from one wall.

DETAILED DESCRIPTION

Figure 2:
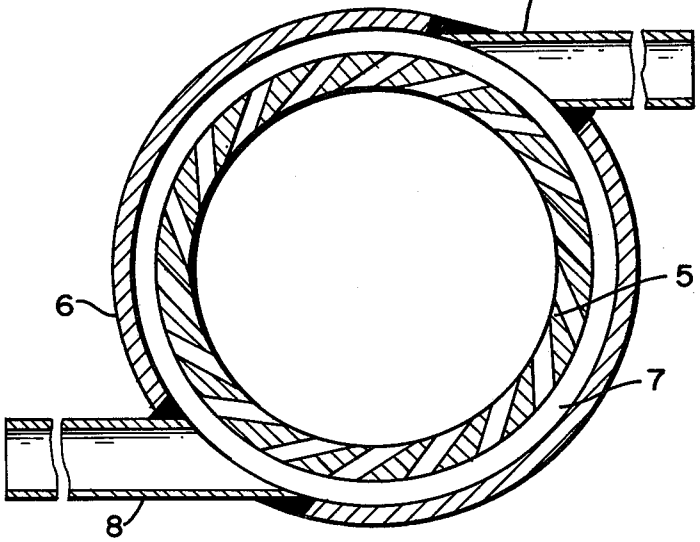
FIG. 2 is a cross-section of a pipe taken on the line A—A of FIG. 1.

The invention will be described with reference to a horizontal pipe although it could also be used in a vertical position or at any angle from vertical or horizontal.

As shown in the drawings, the device comprises an inner pipe and outer wall. The outer is fluid-tight and carries the piping loads. In between the two is an annulus into which quench liquid is admitted. The quench liquid is discharged through a number of slots formed by machining grooves in the downstream section of the pipe which is in substantially abutting relationship with the upstream section. Alternatively, the grooves could be cut in the latter. The gap shown between the two sections exists in the cold condition. When hot, the two pieces expand and approach closely or may may make contact. A deflector lip is preferably provided to aid in preventing backflow of liquid upstream of the locus of injection caused by centrifugal force tending to spread out the liquid in both upstream and downstream directions. It also defines precisely the boundary between wet and dry regions of the pipe inner surface. The deflector lip is present by virtue of the internal diameter of the upstream section being smaller than the internal diameter of the downstream section where they approach, although this may be done by other means. Alternatively, a one-piece construction could be used but the device illustrated is preferred to facilitate manufacture. It is located as near as possible to the collection manifold (not shown) for the outlets of the pyrolysis tubes or coils of a steam cracking furnace or other source of hot cracked gas such as a high pressure hydrocracking system or a cocracking (integrated coking and steam cracking) process.

The number of slots and size of the slots are selected in relation to the pipe internal diameter. These parameters are chosen to permit achieving the desired high ratio of flow rate of injected liquid coolant to flow rate of cracked gas so that sufficient coolant is drawn into the cracked gas stream where it mixes with the gas and heat exchange with quenching occurs. The slots are also sized so as to provide a velocity of the liquid such that there is a proper distribution thereof, viz., a uniform amount of liquid coming out of each slot. Preferably they are symmetrically arranged. The slots are slanted away from the center of the quench pipe thereby to impart a swirling motion to the injected liquid. The swirl-type motion may be strictly tangential but preferably is substantially so, viz., almost but not quite tangential, i.e., preferably a component of flow is towards the center of the pipe. This depends on the degree of slant of the slots away from the center. The nearly or substantially tangential injection of the cooling liquid and the high ratio of liquid/gas flows, cooperate with the result that a substantial amount of the liquid is swept into the streaming gas so that quenching can take place. A portion of the liquid remains on the inner pipe surface where it keeps the wall wet in a uniform, non-fluctuating manner, thereby preventing coke formation upon the wall. The orientation of the slots is thus instrumental in providing proper balance between the amount of liquid on the wall and the amount being entrained by the cracked gas.

Figure 1:
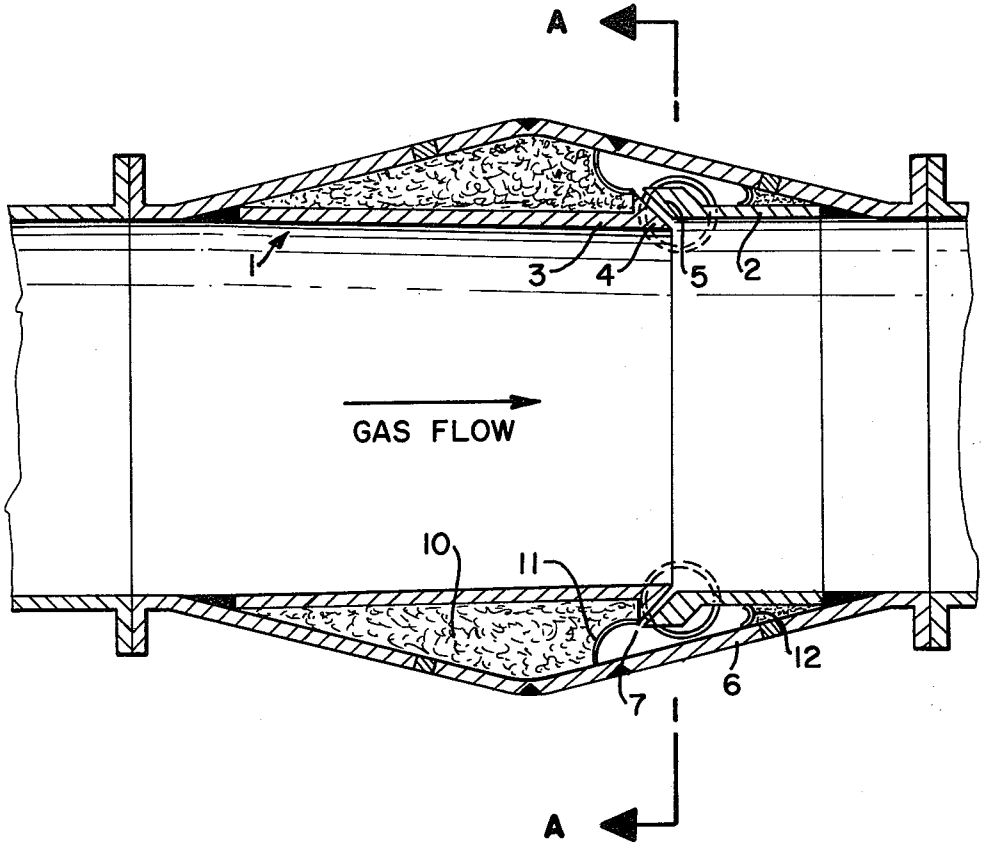
FIG. 1 is a cross-section of a side view of a pipe according to the invention.

As shown in FIGS. 1 and 2, the quench pipe 1 is formed from a downstream section 2 and an upstream section 3, the ends of which are in substantially abutting relationship. The end of section 3 is preferably formed with a deflector lip 4 which overhangs the end of section 2 comprising the grooved portion 5. The grooved portion 5, with the end of section 3, form the slots. The direction of gas flow is shown by the arrow. As regards the abutting ends of these sections, the following may be noted. The grooves are preferably straight cuts in the metal. They are slanted away from the pipe diameter, i.e., from the center of the pipe, as shown in FIG. 2. The degree of slant determines whether the injected liquid will flow in a strictly tangential or in a substantially tangential manner. Additionally, the abutting ends are preferably tapered or shaped so that they describe an angle of, for example, about 45° from horizontal, as shown in FIG. 1. Thus the slots slope in a downstream direction. The downstream incline of the slots and the deflector lip both function to prevent backflow of the coolant, viz., in an upstream direction. This aids in avoiding fluctuation of wet/dry areas. For a pipe having an internal diameter of about 14 inches one may suitably use 18 slots, each being about 0.5 inches wide and 0.37 inches high. The slots are surrounded and enclosed by a fluid-tight outer wall member 6 suitably welded to pipe 1 which, with pipe 1, forms an annulus or plenum chamber 7 for injection of quench liquid through pipes 8 and 9. Insulation 10 is provided between pipe 1 and outer wall member 6, with sealing strips 11 and 12 to prevent quench liquid from wetting the insulation 10 between the inner and outer walls.

In operation the cracked gas stream flows from a source (not shown) which may be a collection manifold for the effluent of the pyrolysis tubes of a cracking furnace or for such effluent after it has passed through a heat exchanger to generate steam, to the quench pipe 1, in the direction shown by the arrow. Quench hydrocarbon oil introduced through pipes 8 and 9 to enclosure 7, at a pressure above that of the gas, suitably of about 20 psia to about 80 psia, is injected substantially tangentially through the slots. The flow rates of coolant and gas are regulated so that the weight ratio is in the range of about 2 to about 15, for example about 2 to about 5 or about 2.5 to about 4.0 for gas oil. To illustrate, a stream cracked hydrocarbon gas stream may be at a temperature in the range of about 1400° to about 1700° F. and at a pressure of about atmospheric to about 50 psia, may be quenched with a hydrocarbon oil at a temperature in the range of about 350° F. to about 600° F., drops through a temperature gradient of about 850 to about 1200 Fahrenheit degrees and leaves the quench pipe at a temperature in the range of about 450° to 650°

F. These conditions may be different under other circumstances or for quenching hot gases from other sources.

The process is illustrated by the following example.

EXAMPLE

The example is carried out using an apparatus as shown in FIGS. 1 and 2 with dimensions as set forth above.

The cracked hydrocarbon gas at a mass flow rate of 48,000 lb/hr flows from a pyrolysis furnace with a velocity of 300 ft/sec., a pressure of 30 psia and a temperature of 1430° F. into the quench apparatus. Cooling hydrocarbon oil having a boiling range of 480° to 670° F. is introduced into pipe 1 through the annular space 7 and then the injection slots formed by grooved portion 5 at a mass flow rate of 140,000 lb/hr and a temperature of 390° F. The cooling oil forms a continuous film around the inside surface of the pipe, having an initial uniform thickness of about 0.08 inches. The cooling oil quenches the cracked gas stream by both direct evaporation at the surface of the oil film (about 2 to 5 percent of the quenching) and by entrainment of bulk liquid into the gas stream as small droplets which then evaporate (about 95 to 98 percent of the quenching). The quenching process is completed at a point about 7 ft. downstream of the point of cooling oil injection, resulting in an after-quench temperature of the gas of 550° F. and an after-quench pressure of 27.5 psia.

It will be understood that the quench pipe is fabricated from a metal having a high temperature tolerance, suitably an austenitic steel such as 25Cr-35Ni. By means of the present invention, long life of the pipe can be expected.

What is claimed is:

1. A method of quenching a cracked hydrocarbon gas which comprises passing a cracked gas stream axially through a pipe and injecting a liquid coolant into said pipe through a plurality of circumferentially arranged slots in a swirling manner, the weight ratio of the flow rate of the coolant to the flow rate of the gas stream being in the range of about 2 to about 15 whereby the centrifugal force of the thus injected coolant causes a portion thereof to contact the inner surface of the pipe, another portion thereof being entrained by the gas stream to effectively cool the same.

2. A method in accordance with claim 1, in which the ratio is in the range of about 2 to about 5 when the coolant vaporizes readily under the conditions of use.

3. A method in accordance with claim 2, in which the ratio is in the range of about 2.5 to about 4.0.

4. A method in accordance with claim 1 in which the coolant flow is substantially tangential to the inner pipe surface.

5. Apparatus for quenching a cracked gas stream from a hydrocarbon cracking furnace which comprises:

a pipe for flow of the cracked gas stream axially therethrough;

said pipe containing a plurality of circumferentially disposed slots which are slanted away from the center of the pipe to impart a swirling motion to liquid coolant injected into the pipe through the slots; the number of slots and size of the slots being large enough relative to the pipe diameter to allow a portion of liquid coolant to contact the inner surface of the pipe and another portion thereof to be entrained by the gas stream to effectively cool the same; and a plenum chamber external to the pipe and enclosing the slots, which is in open communication with the slots and with a source of liquid coolant, for injecting liquid coolant under pressure through the slots.

6. Apparatus in accordance with claim 5 in which the pipe is formed of two substantially abutting sections, the downstream section being grooved to form with the upstream section the said slots, and comprising means for maintaining the two sections in substantially abutting relationship.

7. Apparatus in accordance with claim 5 or 6 in which the number and size of the slots relative to the pipe diameter permits injection of coolant in a weight ratio of flow rate of coolant to flow rate of gas of about 2 to about 15.

8. Apparatus in accordance with claim 5 or 6 in which the slots are slanted away from the center of the pipe so that the coolant flow is substantially tangential to the inner pipe surface.

9. Apparatus for quenching a cracked hydrocarbon gas stream which comprises:

a pipe for flow of the cracked gas stream axially therethrough;

said pipe containing a plurality of circumferentially disposed tangential or substantially tangential slots, said slots being in alignment around the circumference and opening directly into the interior of the pipe through which the gas stream flows to impart centrifugal force to liquid coolant injected into the pipe through said slots;

the number of slots and size of the slots being large enough relative to the pipe diameter to allow a portion of said liquid coolant to contact the inner surface of the pipe and another portion thereof to be entrained by the gas stream to effectively quench the same; and a plenum chamber external to the pipe and enclosing the slots, which is in open communication with the slots and with a source of liquid coolant, for injecting liquid coolant under pressure through the slots.

10. Apparatus in accordance with claim 5, 6 or 9 in which the section of pipe upstream of the slots has an internal circumferentially arranged deflector lip which protrudes over the slots to prevent backflow of liquid coolant.

11. Apparatus in accordance with claim 10, in which the deflector lip is formed by the upstream section of the pipe being of narrower internal diameter than the downstream section of the pipe.

12. Apparatus in accordance with claim 10 in which the slots slope in a downstream direction.

13. Apparatus in accordance with claim 10 in which the shape of the slots is substantially straight.

* * * * *